US006902449B1

(12) United States Patent
Faucheux et al.

(10) Patent No.: US 6,902,449 B1
(45) Date of Patent: Jun. 7, 2005

(54) WATERCRAFT DRIVE UNIT

(76) Inventors: Derrick Faucheux, 15750 Highway 182, Franklin, LA (US) 70538; Joel J. Miller, 214 Cedar St., Franklin, LA (US) 70538

( * ) Notice: Subject to any disclaimer, the term of this patent is extended or adjusted under 35 U.S.C. 154(b) by 0 days.

(21) Appl. No.: 10/815,011

(22) Filed: Mar. 30, 2004

(51) Int. Cl.[7] ..... B63H 5/125
(52) U.S. Cl. ..... 440/57; 440/61 S; 440/61 T
(58) Field of Search ..... 440/53, 57, 61 R, 440/61 S, 61 T

(56) References Cited

U.S. PATENT DOCUMENTS 3,933,116 A * 1/1976 Adams et al. ..... 440/57
4,275,902 A * 6/1981 Teja ..... 280/766.1
5,249,993 A * 10/1993 Martin ..... 440/73
5,931,710 A 8/1999 Johnson, Sr.
6,418,717 B1 * 7/2002 Christiaens et al. ..... 60/588

* cited by examiner

*Primary Examiner*—Stephen Avila
(74) *Attorney, Agent, or Firm*—William W. Stagg

(57) ABSTRACT

An improved drive unit for propelling a watercraft through shallow water comprising a steering box pivotally attached to the watercraft transom; a first drive shaft extending through the transom to the steering box; a second drive connected to said first drive shaft by means of a double universal joint; and a drive shaft housing for the second drive shaft, the housing being pivotally connected to the steering box to allow the drive shaft housing to pivot vertically on the steering box. A propeller is mounted to the second propeller shaft for propelling the watercraft. A single action spring-return hydraulic ram, said ram having a housing, a piston and a piston rod, is attached to absorb movement of the shaft housing in the event that an obstacle is encountered. The hydraulic ram is provided with means for moving the ram piston and thereby the piston rod to raise and lower said drive shaft housing and propeller.

24 Claims, 6 Drawing Sheets

WATERCRAFT DRIVE UNIT

FIELD OF THE INVENTION

This invention relates generally to drive units for watercraft and, more particularly, to an improved drive unit for propelling a watercraft through very shallow water.

BACKGROUND OF INVENTION

Outboard motors are typically used to propel small shallow water boats. These outboard motors generally are comprised of a portable frame on which is mounted an internal combustion engine for power, a substantially vertically orientated drive shaft and housing extending from the engine, a substantially horizontally orientated propeller shaft in communication with a propeller, and a transmission unit positioned between the drive shaft and the propeller shaft to control transfer of engine power from the drive shaft to the propeller shaft and propeller. Such outboard motors typically require a portion of the drive shaft housing and the propeller to be submerged in the water for proper function of the motor. This causes problems in shallow water operation due to chance from frequent interference and collisions of the propeller and drive shaft housing with the water bottom or obstructions protruding from the water bottom.

Various arrangements are employed with typical outboard motor arrangements to affect their use in shallow water. These arrangements include providing a jacking means to lift the motor and propeller to reduce the depth of propeller submergence in the water or by providing a "tunnel" or channel in the hull of the boat and positioning the motor within the channel to reduce the depth the propeller must extend into the water to propel the boat.

Other outboard motors employ engines having drive assemblies comprised of a longitudinally extending drive shaft or rotating a propeller. Such motors are typically attached to a frame that is mounted on the transom of the boat in such a manner that it may be freely pivoted both up and down and side by means of a tiller or handle mounted on the frame opposite the extending drive shaft. In this manner, the tiller may be used to move the extending drive shaft and rotating propeller into and out of the water to avoid obstructions and side to side for steering as the boat is propelled. Such systems typically employ propellers that spin in only one direction and thus do not easily provide for reversing the direction of the boat. These types of outboard systems are also physically demanding on the operator in that the operator is constantly lifting the driveshaft and propeller into and out of the water during operation. Further, the operator must often stand in the boat during operation, which may increase the risk of falling from the boat if an obstacle is encountered.

Another driving mechanism for shallow water watercraft is that described in U.S. Pat. No. 5,931,710 to Clyde Johnson. This mechanism employs a small boat having an inboard-outdrive system to facilitate travel at low speed in very shallow water. The outdrive mechanism described by Johnson has a propeller drive shaft mounted within a driveshaft tube housing. This driveshaft and tube housing extend longitudinally through the transom of the boat. The drive shaft is attached to a propeller mounted on the driveshaft tube housing for propulsion of the boat. A fin mounted on the driveshaft tube housing below the propeller serves as a propeller guard. The driveshaft is connected to a bearing and bearing box assembly mounted to the boat transom to allow the driveshaft and housing to pivot upward and downward.

A chain is attached to the driveshaft tube housing to support the extending driveshaft in a desired horizontal position. A hydraulic shock absorber, mounted to the extending driveshaft tube housing and to the outside of the boat transom below the chain, provides a self-adjusting downward force on the drive shaft to maintain tension on the chain to keep the driveshaft in a substantially horizontal position. When the extended driveshaft encounters an obstruction, the chain and shock absorber mechanism allows the driveshaft to be displaced vertically and then repositioned to its substantially horizontal operating position when the obstruction is passed. A cable and pulley mechanism mounted on the boat is employed to lift the driveshaft and propeller in and out of the water. A pivot pin is mounted on the driveshaft tube allows the use of a steering actuator to pivot the driveshaft from side to side in its horizontal position for steering. This steering actuator is mounted outside the boat and positioned at or just above the water line. The cable and pulley assembly described by Johnson to raise and lower the driveshaft take up space in the small boats where available space is typically limited. The chain and steering actuator described in Johnson are vulnerable to debris and other obstructions common in shallow water that may damage or inhibit the steering and lifting mechanisms creating an inability to drive or steer the boat.

SUMMARY OF THE INVENTION

Applicant provides an improved drive unit for a small boat that eliminates the disadvantages associated with the previous systems. The drive unit consists of transom plate mounted on a boat hull. The transom plate has upper and lower outwardly extending brackets and a hull opening, positioned between the upper and lower brackets, for receiving a first rotatable drive shaft segment turned by an engine and transmission means mounted within the boat.

Essential to Applicants' design is a pivot box that is pivotally mounted on the transom plate by bushings, between the upper and lower brackets, in a manner that allows the pivot box to be turned or pivoted horizontally for steering. A hollow extending pipe, or shaft log, is pivotally mounted on bushings at the pivot box to allow the extending shaft log to pivot vertically. Upper and lower drive shaft bearings support a second drive shaft within the extending shaft log. A double universal joint, centrally positioned within the pivot box, forms the connection between the first and second drive shaft segments. The second drive shaft segment extends from the universal joint within the pivot box through the shaft log. A propeller is mounted to the distal end of the second drive shaft for propulsion. The double universal joint allows both the vertical and the horizontal movement of the second drive shaft segment as it rotates during operation.

The shaft log and propeller are protected from obstructions by a skeg plate that extends downward from the shaft log below the propeller. A cavitation plate mounted on the shaft log above the propeller ends outward in a transverse direction from the shaft log. This cavitation plate is intended to ride the water above the propeller to maintain water pressure around the propeller and avoid cavitation and propeller slippage.

A single acting, spring-return, hydraulic ram is positioned between the upper portion of the pivot box and to the shaft log. The hydraulic ram is actuated by a fluid pump mechanism controlled from a console within the boat. This spring-return, hydraulic ram serves to raise and lower the shaft log and propeller and absorbs impact from obstructions encountered during operation.

DETAILED DESCRIPTION OF THE INVENTION

Figure 1:
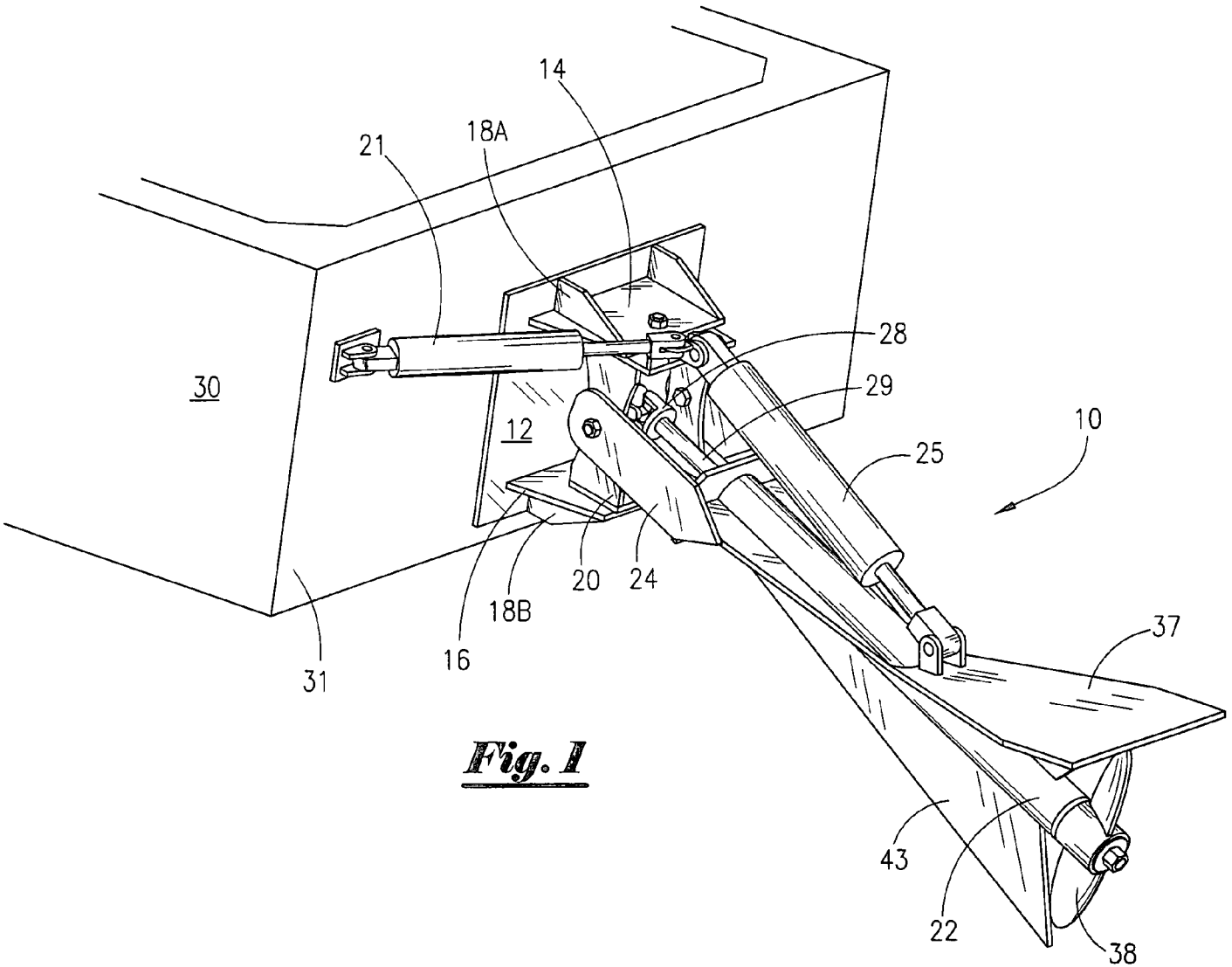
FIG. 1 is a perspective view of the rear portion of a boat having the drive unit of Applicants' invention.

FIG. 1 shows a perspective view of the rear portion of a boat (30) having the drive unit (10) of Applicants invention. The drive unit (10) is attached to the transom (31) of the boat (30) by means of a transom plate (12). Mounted on the transom plate (12) are an upper bracket plate (14) with flange (18A) and a lower bracket plate (16) with flange (18B). Pivotally mounted to transom plate (12) between the upper bracket plate (14) and the lower bracket plate (16) on bushings (17) is a pivot box (20). A hollow extending pipe called a shaft log (22) is pivotally mounted on the pivot box (20) by a pair of extending shaft mounts (24) and bushings (19) to allow the extending shaft log (22) to pivot vertically up and down. It is thought that greased brass bushings would be used for bushings (17) and (19) pivot connects of the pivot box (20) though other suitable materials may be used.

A steering arm (21) is attached to the pivot box (20). The steering arm (21) is used to rotate the pivot box (20) on the bushing (17) to turning the pivot box (20) to the right or left for steering the boat (30). The steering arm (21) is preferably hydraulically activated by means of a hydraulic pump, lines and steering system (not shown) located in the boat (30). While Applicants' suggest a hydraulic steering system for the drive unit (10) herein described, other systems such a cable systems might be utilized to manipulate the steering arm (21).

Figure 2:
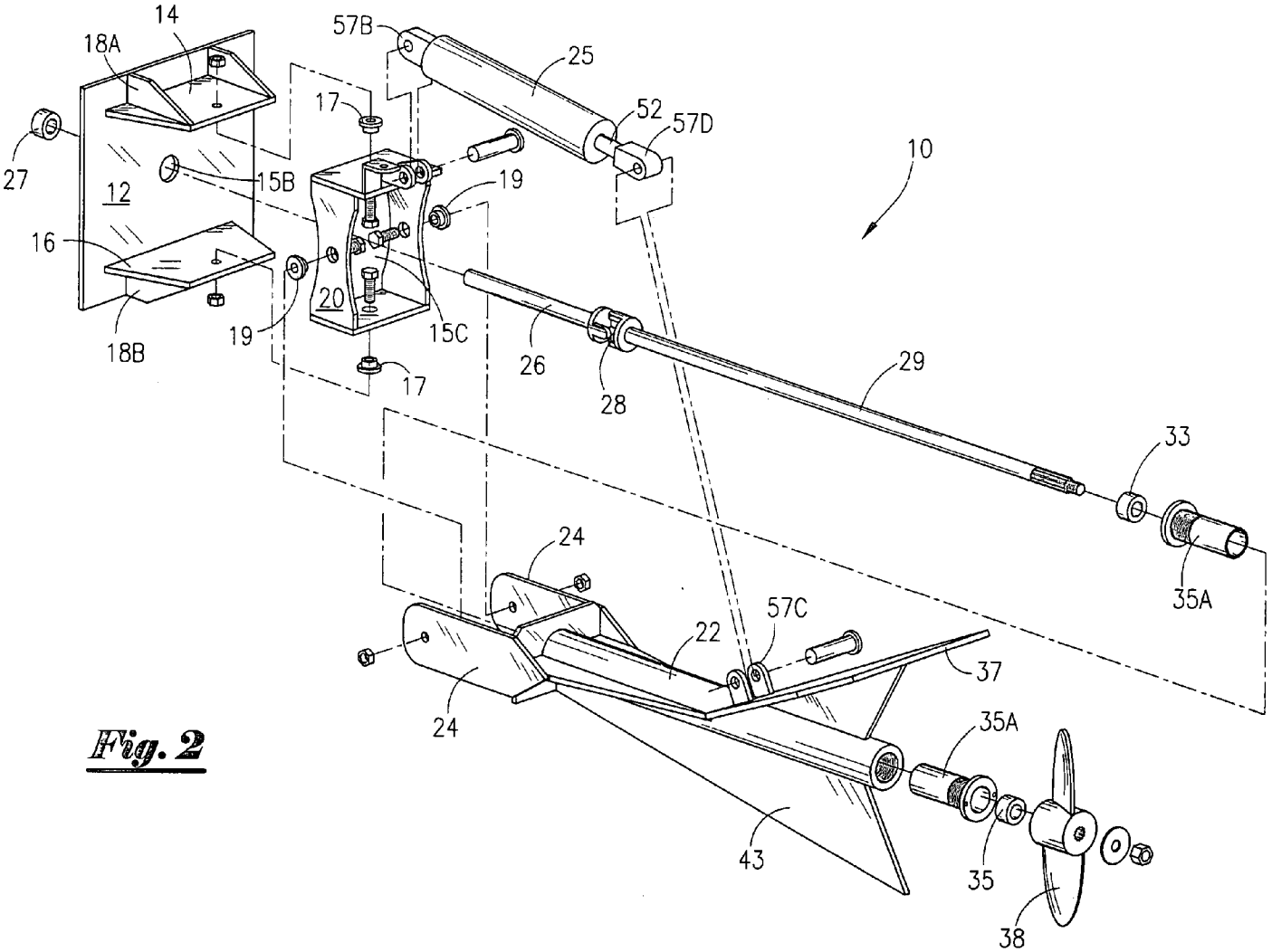
FIG. 2 is an exploded view of the drive unit of FIG. 1.
Figure 3:
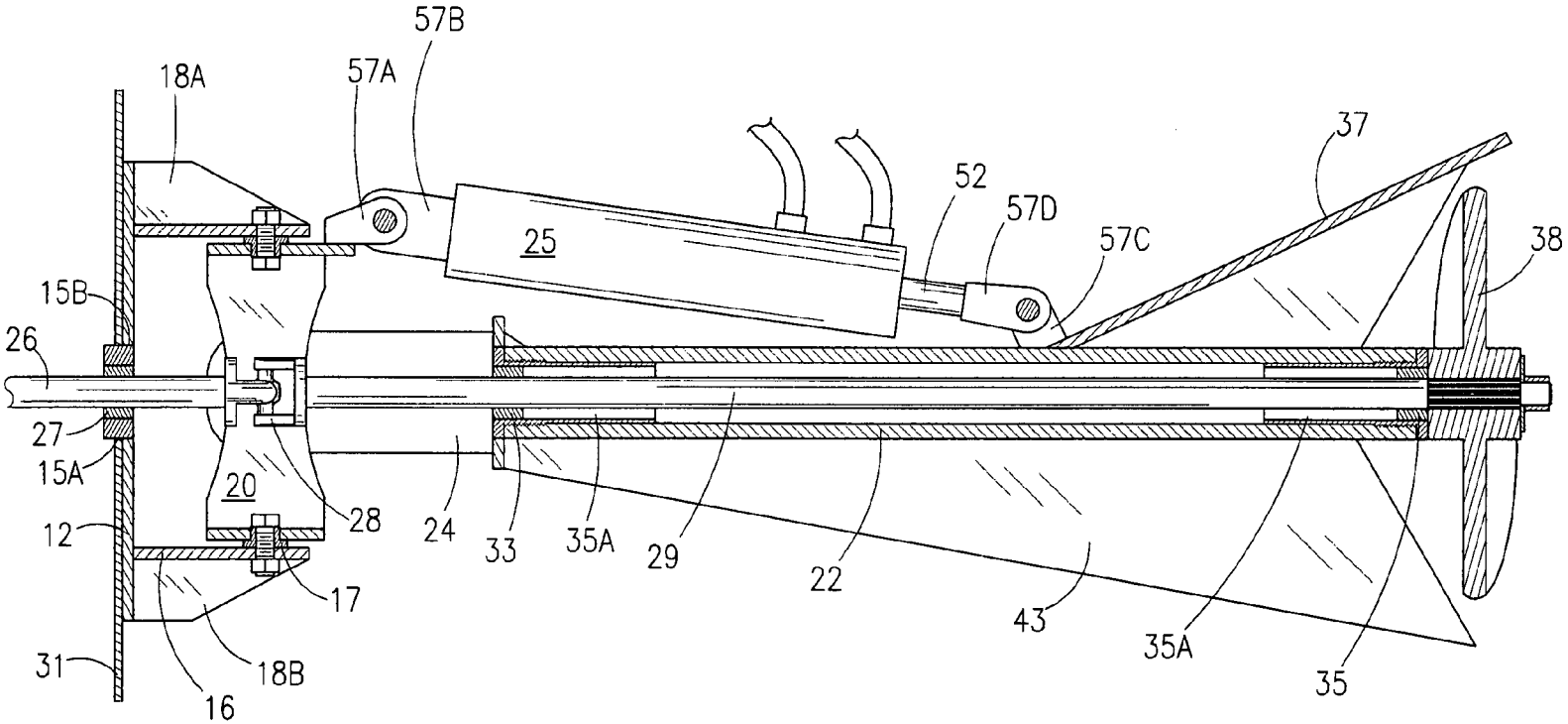
FIG. 3 is a longitudinal cross-sectional view of the drive unit of FIG. 1.

As shown in FIG. 2, an exploded view of the drive assembly (10), and in FIG. 3, a longitudinal cross-sectional view of the drive assembly (10), the pivot box (20) is rectangularly configured and pivotally mounted, on bushings (17), between the bracket plates (14, 16). The boat transom (31) has an opening (15A) that corresponds to an opening (15B) in transom plate (12) that is positioned between the upper and lower brackets (14) and (16). A first rotatable drive shaft segment (26), supported on transom shaft bearing (27), through openings (15A) and (15B) is rotated and controlled by an engine and transmission means (not shown) mounted within the boat (30). This first drive shaft segment (26) enters the pivot box (20) through pivot box drive shaft opening (15C) and terminates at a double universal joint (28) that is centrally positioned within the pivot box (20).

A second rotatable drive shaft segment (29) in connection with the universal joint (28), through pivot box drive shaft opening (15D), extends from the pivot box (20) and through the shaft log (22) and is held in place by an upper drive bearing (33) and a lower, water-lubricated, bronze/rubber bearing (35) and stainless steel bearing sleeve (35A). The pivot box (20) as shown has an open rear face but a cover plate (not shown) may be attached to the rear of the box (20) to cover the universal joint assembly.

A weedless propeller (38) is mounted to the distal end of the second drive shaft segment (29) for propulsion. The double universal joint (28) allows for both vertical and horizontal movement of the second drive shaft segment (29) as it rotates the propeller (38) during operation of the drive unit. Ideally a "true weedless" propeller is utilized to run through tangled vegetation.

Figure 5:
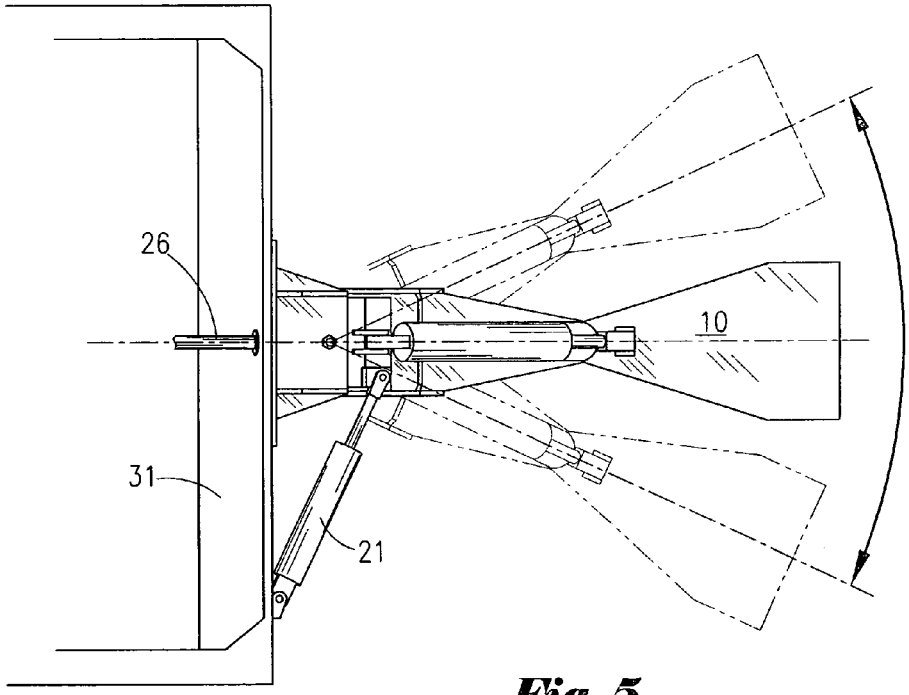
FIG. 5 is a top view of the drive unit of FIG. 1.

The shaft log (22) and bearings (33) and (35) protect the second drive shaft segment (29) from damage and warping. As shown in FIG. 3, the lower bearing (35) holds the drive shaft (29) centered in the shaft log (22) as the drive shaft (29) exits the shaft log (22). The lower bearing (35) also acts as an impact bearing mechanism in the event the drive shaft (29) or the propeller (38) encounters an obstruction. The bearing sleeve (35A), shown in cross-section in position on the shaft log (22) in FIG. 5, is mounted within the shaft log (22) for easy removal by means of an adjustable spanner wrench obtainable from most marine supply stores. This facilitates the replacement of the bronze/rubber bearing (35) in the event of excessive wear and tear.

A skeg plate (43) is mounted on the shaft log (22) to extend downward from the shaft log to a point below the propeller (38) to protect the propeller from the impact of obstructions that might be encountered in shallow water. A cavitation plate (37) mounted on the shaft log (22) above the propeller (38) extends outward in a transverse direction from the shaft log. This cavitation plate (37) is intended to ride at the water surface above the propeller in order to maintain water pressure around the propeller (38) and avoid cavitation and propeller slippage during operation of the unit.

Figure 6:
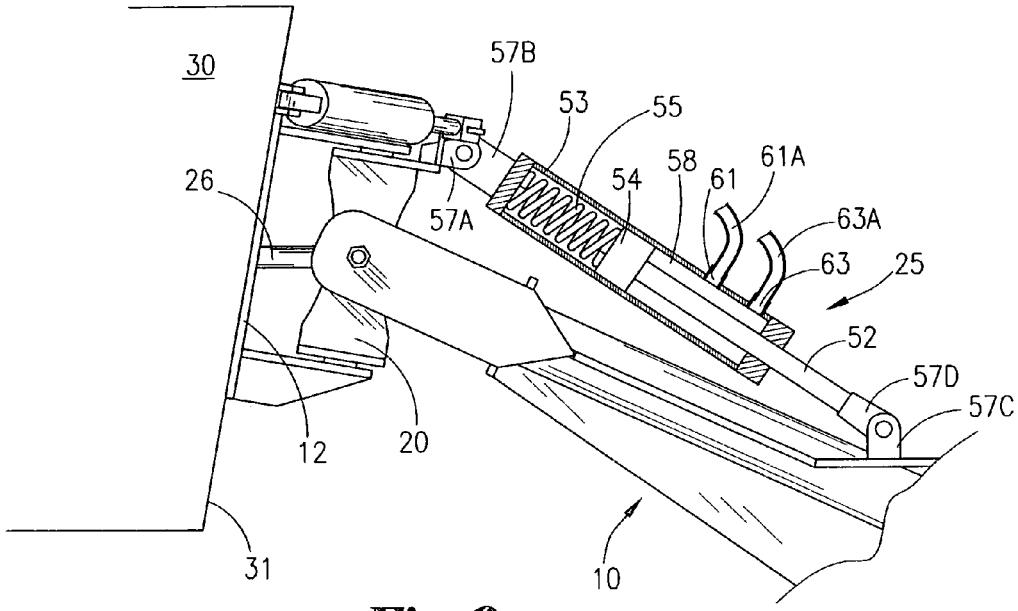
FIG. 6 is a cross-sectional view of the spring actuated hydraulic ram assembly mounted on the lower shaft log of the drive unit of FIG. 1.

As can be seen in the drawings, and more particularly in FIG. 6, a cross-section through the spring-return hydraulic ram (25), a single acting, spring-return, hydraulic ram (25) is mounted between the top of the pivot box (20) and the shaft log (22). The hydraulic ram (25) has an input fluid port (61) connected to an input fluid line (61A) and a discharge fluid port (63) connected to a discharge fluid line (63A), all actuated by a fluid pump mechanism controlled from a console within the boat (not shown). This spring-return, hydraulic ram (25) serves to raise and lower the shaft log (22) and propeller (38) and absorbs impact from obstructions that push the shaft log (22) upward during operation of the unit.

The ram (25) has a cylindrical housing (53), a ram piston (54), a piston rod (52) and a return spring (55) positioned inside the ram above the ram piston (54). The housing (53) of the ram (25) is pivotally mounted to a first ram bracket (57A) fixed to the pivot box (20) by means of a first ram connector (57B). The distal end of the piston rod (52) is pivotally mounted to a second ram bracket (57C) fixed to the shaft log (22) by means of a second ram connector (57D) fixed at the end of the piston rod (52).

A hydraulic fluid chamber (58) is located within the housing (53) below the ram piston (54) opposite the spring (55). The ram piston (54) is moved against the spring (55) by pumping hydraulic fluid under pressure into the fluid chamber (58) through inlet port (61) via fluid supply line (61A). This movement of the piston (54) draws the piston rod (52) into the housing and thus raises the shaft log (22) and the propeller (38) from the water. The shaft log (22) and the propeller (38) are lowered into the water by releasing the hydraulic pressure on the piston (54) by evacuating the fluid in the fluid chamber through fluid drain port (63) via fluid drain line (63). When the fluid pressure is released, through outlet port (63) via fluid discharge line (63A), the spring (55) pushes against the piston (54) and thus returns or extends the piston shaft (52) lowering the shaft log (22) and the propeller (38). In addition to returning the piston rod (52) to its extended position, the spring (55) serves to absorb some of the impact from the stumps, logs, vegetation, water bottom and other such obstacles that the shaft log (22) and skeg plate (43) will encounter while the unit (10) is operating in shallow water.

The fluid into the ram (25) is controlled by a hydraulic pump (not shown) located in the boat, the pump being controlled by switches mounted on the boat dashboard or console. It is thought that the hydraulic pump will be electrically operated though other hydraulic pumps could be utilized. When the unit (10) is in its operating or float mode, the fluid is removed from the cylinder (58), so that when the shaft log (22) or skeg plate (43) encounters and obstacle the piston rod (52) and thus the piston (54) will retract almost instantaneously against the spring (55) cylinder lifting the propeller (38) up from the obstacle and then the spring will extend the rod (52) to lower the unit after the obstacle is past.

Figure 4:
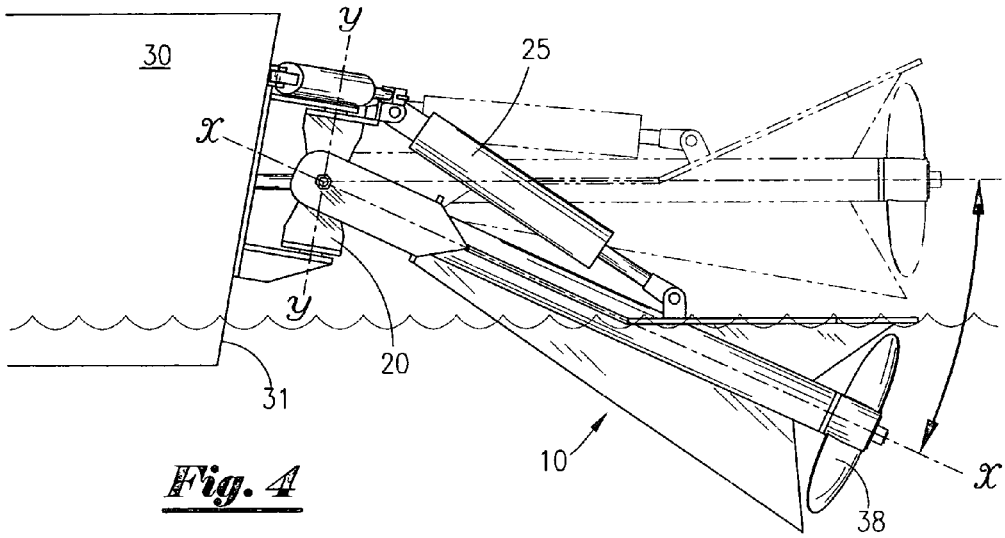
FIG. 4 is a side view of the drive unit of FIG. 1.

In operation, as shown in FIG. 4 and FIG. 5, the shaft log (22) extends outward along the longitudinal axis of the watercraft and is pivoted on the shaft mounts (24) and bushings (19) by removing hydraulic fluid from the ram fluid chamber (58) via fluid lines (63A) and fluid inlet port (63) and thereby allowing the associated drive shaft (29) and propeller (38) to be lowered into the water. Once lowered, the drive unit (10) is in its running or operating position. The engine and transmission are engaged to turn the first drive shaft segment (26) which, by means of the double universal joint (28) that is centrally positioned within the pivot box (20), turns the second rotatable drive shaft segment (29) to deliver power the propeller (38). The boat (30) is turned to the left or right by means of the steering arm (21) attached to the pivot box (20).

Lateral movement of the steering arm (21) moves or pivots the pivot box (20) on the bushings (17) in a horizontal direction, and thus the attendant shaft log (22) and propeller (38), to position the shaft log in a desired position to steer the watercraft. In the event an obstacle is encountered by the skeg plate (43), the shaft log (22) is moved vertically away from the obstacle, which in turn, moves the piston rod (52) and its connected piston (52) against the cylinder spring (55) to absorb the impact of the obstacle. When the obstacle is passed, the spring (55) in the ram (25) as well as the weight of the shaft log (22) and propeller (38) returns the unit (10) to its operating position. The shaft log (22) and propeller (38) may be raised as needed by pumping hydraulic fluid under pressure into fluid chamber (58) of the hydraulic ram (25) via fluid supply line (61A). In this manner the unit may be raised as necessary to trailer the boat or to clear debris from the unit components if necessary.

Figure 7:
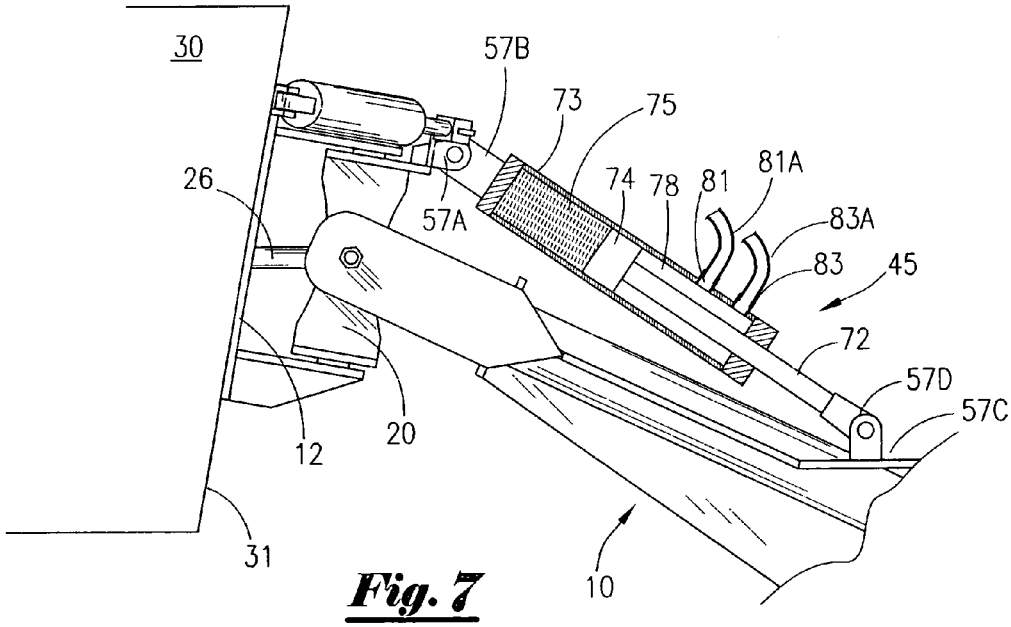
FIG. 7 is a cross-sectional view of a gas actuated hydraulic ram assembly mounted on the lower shaft log of the drive unit of FIG. 1.

FIG. 7 shows an alternate embodiment (45) of the spring-return hydraulic ram (25) shown in FIG. 6. In FIG. 7, there is shown single acting gas-return hydraulic ram (45) the having a cylindrical housing (73), a ram piston (74), a piston rod (72) and a return gas chamber (75) filled with a compressible gas such as nitrogen positioned inside the ram above the ram piston (74). The return gas chamber (75), and its contained compressible gas, replaces the spring (55) of the hydraulic ram (25).

The housing (73) of the ram (45) is pivotally mounted to a first ram bracket (57A) fixed to the pivot box (20) by means of a first ram connector (57B). The distal end of the piston rod (72) is pivotally mounted to a second ram bracket (57C) fixed to the shaft log (22) by means of a second ram connector (57D) fixed at the end of the piston rod (52) as shown for the spring-return hydraulic ram (25). The gas-return hydraulic ram (45) has an input fluid port (81) connected to an input fluid line (81A) and a discharge fluid port (83) connected to a discharge fluid line (83A), all actuated by a fluid pump mechanism controlled from a console within the boat (not shown). This gas-return, hydraulic ram (45) also serves to raise and lower the shaft log (22) and propeller (38) and absorbs impact from obstructions that push the shaft log (22) upward during operation of the unit.

Figure 8:
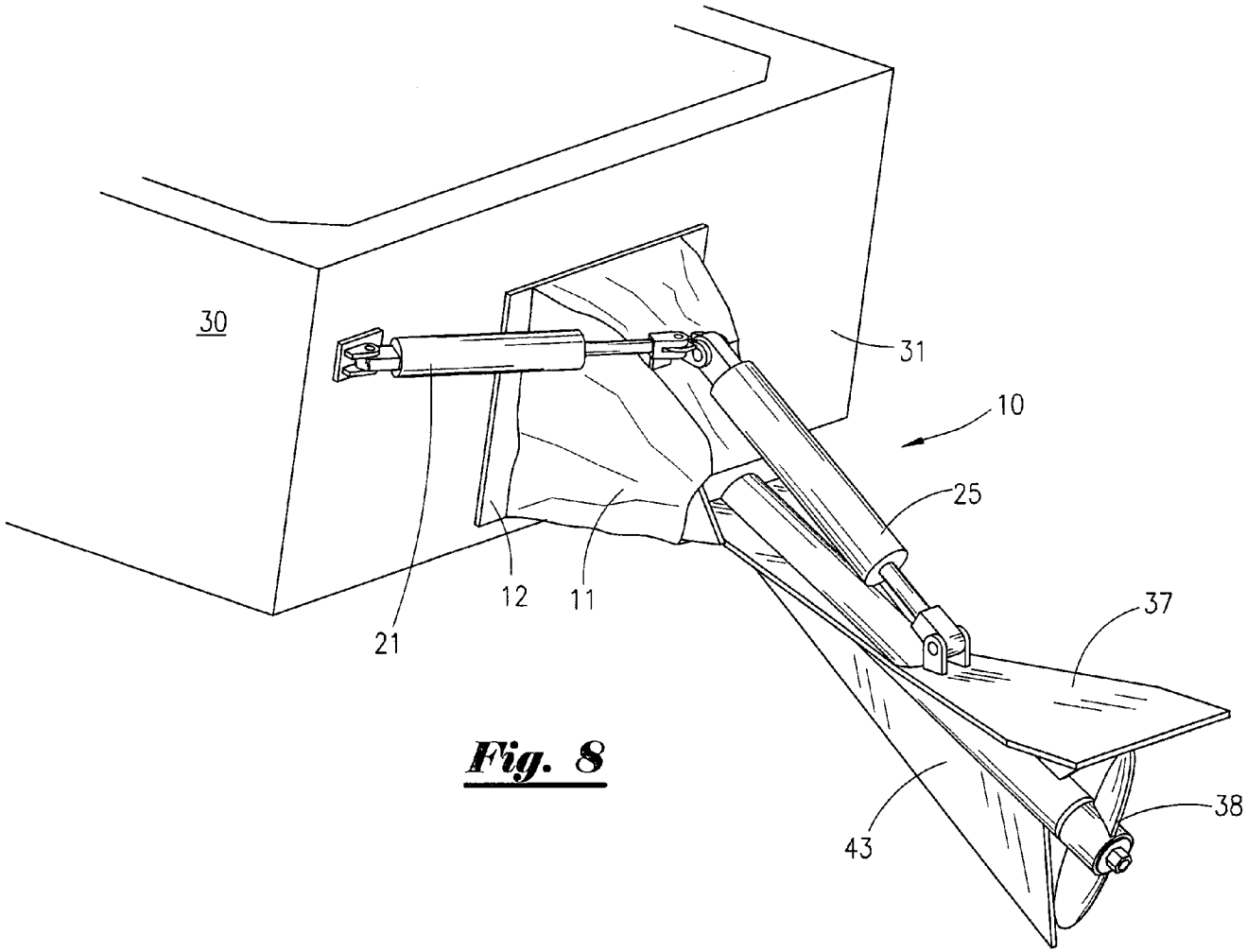
FIG. 8 is a perspective view of the rear portion of a boat having the drive unit of Applicants' invention.

As shown in FIG. 8, the pivot box (20), the bracket plates (14, 16) and the double universal joint (28) of the drive unit (10) may be covered with a boot or shroud (11) to protect these mechanisms during operation of the unit. The shroud (11) may be comprised of a water resistant fabric or other pliable material.

It is thought that the drive unit of Applicants' invention and many of its attendant advantages will be understood from the foregoing description. One skilled in the art will appreciate that the present invention can be practiced by other than the described embodiments, which are presented for purposes of illustration and not limitation.

What is claimed is:

1. A transom mounted watercraft drive unit comprising:

a) a support plate mounted to the watercraft transom, said support plate having a sleeve for receiving a first drive shaft, said first drive shaft extending through said transom and said transom sleeve;

b) an upper bracket and a lower bracket mounted to said support plate, said upper bracket having an upper pivot attachment means and said lower bracket having a lower pivot attachment means;

c) a pivot member pivotally attached to said support plate between said upper bracket and said lower bracket at said upper and lower pivot attachment means whereby said pivot member may be pivoted horizontally;

d) a double universal joint positioned within said pivot member, said double universal joint being connected to said first drive shaft;

e) a drive shaft housing pivotally connected to said pivot member whereby said drive shaft housing may be pivoted vertically on said pivot member;

f) a second drive shaft positioned within said drive shaft housing, said second drive shaft connected to said double universal joint whereby said drive shaft maybe pivoted vertically and horizontally;

g) a propeller mounted to said second propeller shaft;

h) a single action spring-return hydraulic ram, said ram having a housing, a piston and a piston rod, said housing being pivotally attached to said pivot member and said piston rod being pivotally attached to said drive shaft housing; and i) means for moving said piston and thereby said piston rod of said hydraulic ram to raise and lower said drive shaft housing and thereby said propeller.

2. The watercraft drive unit as recited in claim 1, further comprising a steering arm for moving said pivot member and thereby said shaft housing horizontally with respect to the said watercraft.

3. The watercraft drive unit as recited in claim 2, further comprising means for remotely controlling the movement of said piston of said hydraulic ram.

4. The watercraft drive unit as recited in claim 3, wherein said shaft housing includes a bearing for supporting said second shaft member.

5. The watercraft drive unit as recited in claim 4, wherein said propeller is a weedless propeller.

6. The watercraft drive unit as recited in claim 5 wherein said steering arm is hydraulically actuated.

7. A transom mounted watercraft drive unit comprising:

a) a support plate mounted to the watercraft transom, said support plate having a sleeve for receiving a first drive shaft, said first drive shaft extending through said transom and said transom sleeve;

b) an upper bracket and a lower bracket mounted to said support plate, said upper bracket having an upper pivot attachment means and said lower bracket having a lower pivot attachment means;

c) a pivot member pivotally attached to said support plate between said upper bracket and said lower bracket at said upper and lower pivot attachment means whereby said pivot member may be pivoted horizontally;

d) a double universal joint positioned within said pivot member, said double universal joint being connected to said first drive shaft;

e) a drive shaft housing pivotally connected to said pivot member whereby said drive shaft housing may be pivoted vertically on said pivot member;

f) a second drive shaft positioned within said drive shaft housing, said second drive shaft connected to said double universal joint whereby said drive shaft maybe pivoted vertically and horizontally;

g) a propeller mounted to said second propeller shaft;

h) a single action gas return hydraulic ram, said ram having a housing, a piston and a piston rod, said housing being pivotally attached to said pivot member and said piston rod being pivotally attached to said drive shaft housing;

i) means for moving said piston and thereby said piston rod of said hydraulic ram to raise and lower said drive shaft housing and thereby said propeller;

j) a steering arm for moving said pivot member and thereby said shaft housing horizontally with respect to the said watercraft; and k) means for remotely controlling the movement of said piston of said hydraulic ram.

8. The watercraft drive unit as recited in claim 3, further comprising a skeg plate attached to said drive shaft housing.

9. The watercraft drive unit as recited in claim 8, further comprising a shroud covering pivot member and said universal joint.

10. A transom mounted watercraft drive unit comprising:

a) a pivot member pivotally attached to the transom of a watercraft whereby said pivot member may be pivoted horizontally with respect to the longitudinal axis of the watercraft;

b) a first drive shaft extending through said transom to said pivot member;

c) a double universal joint positioned within said pivot member, said double universal joint being connected to said first drive shaft;

d) a drive shaft housing pivotally connected to said pivot member whereby said drive shaft housing may be pivoted vertically on said pivot member;

e) a second drive shaft positioned within said drive shaft housing, said second drive shaft connected to said double universal joint whereby said drive shaft maybe pivoted both vertically and horizontally;

f) a propeller mounted to said second propeller shaft;

g) a single action spring-return hydraulic ram, said ram having a housing, a piston and a piston rod, said housing being pivotally attached to said pivot member and said piston rod being pivotally attached to said drive shaft housing; and h) means for moving said piston and thereby said piston rod of said hydraulic ram to raise and lower said drive shaft housing and thereby said propeller.

11. The watercraft drive unit as recited in claim 10, further comprising a steering arm for moving said pivot member and thereby said shaft housing horizontally with respect to the said watercraft.

12. The watercraft drive unit as recited in claim 11, further comprising means for remotely controlling the movement of said piston of said hydraulic ram.

13. The watercraft drive unit as recited in claim 10, wherein said shaft housing includes a bearing for supporting said second shaft member.

14. The watercraft drive unit as recited in claim 12 wherein said steering arm is hydraulically actuated.

15. The watercraft drive unit as recited in claim 14, wherein said propeller is a weedless propeller.

16. A transom mounted watercraft drive unit comprising:

a) a pivot member pivotally attached to the transom of a watercraft whereby said pivot member may be pivoted horizontally with respect to the longitudinal axis of the watercraft;

b) a first drive shaft extending through said transom to said pivot member;

c) a double universal joint positioned within said pivot member, said double universal joint being connected to said first drive shaft;

d) a drive shaft housing pivotally connected to said pivot member whereby said drive shaft housing may be pivoted vertically on said pivot member;

e) a second drive shaft positioned within said drive shaft housing, said second drive shaft connected to said double universal joint whereby said drive shaft maybe pivoted both vertically and horizontally;

f) a weedless propeller mounted to said second propeller shaft;

g) a single action gas-return hydraulic ram, said ram having a housing, a piston and a piston rod, said housing being pivotally attached to said pivot member and said piston rod being pivotally attached to said drive shaft housing;

h) means for moving said piston and thereby said piston rod of said hydraulic ram to raise and lower said drive shaft housing and thereby said propeller;

i) a hydraulically actuated steering arm for moving said pivot member and thereby said shaft housing horizontally with respect to the said watercraft; and j) means for remotely controlling the movement of said piston of said hydraulic ram.

17. The watercraft drive unit as recited in claim 16, further comprising a skeg plate attached to said drive shaft housing.

18. The watercraft drive unit as recited in claim 17, further comprising a cavitation plate mounted on said shaft housing above said propeller.

19. A method of propelling a watercraft in shallow water comprising the steps of:

a) pivotally attaching a box to the transom of said watercraft whereby said a said box may be pivoted horizontally with respect to the longitudinal axis of the watercraft;

b) extending a first drive shaft through said transom to said box;

c) attaching a double universal joint to said first drive shaft;

d) pivotally attaching a drive shaft housing to said box pivot member whereby said drive shaft housing may be pivoted vertically on said box;

e) connecting a second drive shaft to said double universal joint whereby said drive shaft maybe pivoted both vertically and horizontally;

f) mounting a propeller to said second propeller shaft;

g) attaching a single action spring-return hydraulic ram, said ram having a housing, a piston and a piston rod, whereby said housing is pivotally attached to said box and said piston rod is pivotally attached to said drive shaft housing; and h) providing means for moving said piston and thereby said piston rod of said hydraulic ram to raise and lower said drive shaft housing and thereby said propeller.

20. The method as recited in claim 19, further comprising the steps of:

(a) attaching a steering arm to said box for turning said box and thereby said shaft housing horizontally with respect to the said watercraft;

(b) providing means for remotely controlling the movement of said piston of said hydraulic ram;

(c) supporting said second shaft member on bearings within said shaft housing;

(d) attaching a skeg plate to said drive shaft housing; and (e) attaching a cavitation plate on said shaft housing above said propeller.

21. A transom mounted watercraft drive unit comprising:

a) a drive shaft support means for supporting a drive shaft log on the watercraft transom;

b) a drive shaft supported within said drive shaft log;

c) means for rotating said drive shaft within said drive shaft log;

d) a propeller mounted to said drive shaft;

e) means for horizontally pivoting said drive shaft log; and f) a hydraulic ram, said hydraulic ram having a longitudinally extending ram housing, said ram housing having a first housing end and a second housing end, a piston disposed within said ram housing between said first and second housing ends, said piston having a first housing end side and a second housing end side, a piston rod, said piston rod having a piston end mounted to said piston on said first housing end side of said piston and an extending end, said extending end of said piston rod being slidably extendable from said first housing end of said ram housing, a return means positioned within said ram housing between said second housing end of said ram housing and said second housing end side of said piston for moving said piston and thereby slidably extending said extending end of said piston rod from said first housing end of said ram housing, and means for providing a fluid between said first housing end side of said piston and said first housing end of said ram housing for moving said piston and thereby retracting said piston rod into said ram housing, said second end of said ram housing being pivotally attached to said drive shaft support means and said extending end of said piston rod being pivotally attached to said drive shaft log.

22. The watercraft drive unit as recited in claim 21 wherein, said return means of said hydraulic ram is a spring-return means.

23. The watercraft drive unit as recited in claim 21 wherein, said return means of said hydraulic ram is a gas-return means.

24. The watercraft drive unit as recited in claim 21 further comprising a drive shaft bearing mechanism for supporting said drive shaft within said drive shaft log, said bearing mechanism comprising:

a) a bearing sleeve having a bore for supporting said drive shaft;

b) a bearing sleeve housing for supporting said bearing sleeve; and c) means for threadably mounting said bearing sleeve housing to said drive shaft log.

* * * * *